US007546882B2

(12) United States Patent
Hollingsworth, Jr. et al.

(10) Patent No.: US 7,546,882 B2
(45) Date of Patent: Jun. 16, 2009

(54) STAND COMPENSATOR

(75) Inventors: Jimmy L. Hollingsworth, Jr., Lafayette, LA (US); Karsten Heidecke, Houston, TX (US); Kevin Wood, Tomball, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 279 days.

(21) Appl. No.: 11/621,865

(22) Filed: Jan. 10, 2007

(65) Prior Publication Data

US 2007/0158076 A1 Jul. 12, 2007

Related U.S. Application Data

(60) Provisional application No. 60/758,486, filed on Jan. 11, 2006.

(51) Int. Cl.
*E21B 19/16* (2006.01)

(52) U.S. Cl. ..... 166/380; 166/77.52; 166/381

(58) Field of Classification Search ..... 166/77.52, 166/380, 379, 381
See application file for complete search history.

(56) References Cited

U.S. PATENT DOCUMENTS

| | | | |
|---|---|---|---|
| 1,454,194 | A | 5/1923 | Thomas |
| 1,842,638 | A | 1/1932 | Wigle |
| 1,844,379 | A | 2/1932 | Campbell |
| 1,891,832 | A | 12/1932 | Parks |
| 2,488,107 | A | 11/1949 | Abegg |
| 2,622,916 | A | 12/1952 | Libin et al. |
| 2,661,979 | A | 12/1953 | Stone |
| 2,712,932 | A | 7/1955 | Gould |
| 3,037,803 | A | 6/1962 | Phillips |
| 3,140,523 | A | 7/1964 | Taylor, Jr. |
| 3,193,116 | A | 7/1965 | Kennedy et al. |
| 3,194,313 | A | 7/1965 | Fanshawe |
| 3,351,372 | A | 11/1967 | Marks et al. |
| 3,793,835 | A | 2/1974 | Larralde |
| 3,902,319 | A | 9/1975 | Olmsted |
| 4,128,888 | A | 12/1978 | Sheldon et al. |
| 4,421,179 | A | 12/1983 | Boyadjieff |
| 4,449,596 | A | 5/1984 | Boyadjieff |
| 4,529,045 | A | 7/1985 | Boyadjieff et al. |
| 4,582,133 | A | 4/1986 | Tambs |
| 4,605,077 | A | 8/1986 | Boyadjieff |

(Continued)

FOREIGN PATENT DOCUMENTS

| | | |
|---|---|---|
| WO | WO 99/34088 | 7/1999 |

(Continued)

OTHER PUBLICATIONS

Partial Search Report, Application No. 07100289.3, Dated Jun. 20, 2007.

(Continued)

*Primary Examiner*—Giovanna C Wright
(74) *Attorney, Agent, or Firm*—Patterson & Sheridan, L.L.P.

(57) ABSTRACT

Methods and apparatus for connecting a tubular to a tubular string are provided. In one embodiment, an apparatus suitable for engaging, compensating, and connecting a tubular includes one or more compensating pistons, an engaging assembly for engaging a tubular, and a connector for connecting the engaging assembly to the one or more compensating pistons while allowing for rotation of the tubular relative to the compensation pistons.

19 Claims, 9 Drawing Sheets

U.S. PATENT DOCUMENTS

| | | | |
|---|---|---|---|
| 4,620,692 | A | 11/1986 | Foreman et al. |
| 4,621,974 | A | 11/1986 | Krueger |
| 4,652,195 | A | 3/1987 | McArthur |
| 4,681,158 | A | 7/1987 | Pennison |
| 4,753,300 | A | 6/1988 | Shaw et al. |
| 4,800,968 | A | 1/1989 | Shaw et al. |
| 4,813,498 | A | 3/1989 | Lynch et al. |
| 4,921,386 | A | 5/1990 | McArthur |
| 5,049,020 | A | 9/1991 | McArthur |
| 5,062,756 | A | 11/1991 | McArthur et al. |
| 5,390,568 | A | 2/1995 | Pietras |
| 5,437,527 | A | 8/1995 | McGill et al. |
| 5,577,566 | A | 11/1996 | Albright et al. |
| 5,645,131 | A | 7/1997 | Trevisani |
| 5,664,310 | A | 9/1997 | Penisson |
| 5,755,289 | A | 5/1998 | Angman et al. |
| 5,755,296 | A | 5/1998 | Richardson et al. |
| 5,791,410 | A | 8/1998 | Castille et al. |
| 5,850,877 | A | 12/1998 | Albright et al. |
| 6,000,472 | A | 12/1999 | Albright et al. |
| 6,056,060 | A | 5/2000 | Abrahamsen et al. |
| 6,073,699 | A | 6/2000 | Hollingsworth, Jr. |
| 6,443,241 | B1 | 9/2002 | Juhasz et al. |
| 6,527,493 | B1 | 3/2003 | Kamphorst et al. |
| 6,550,128 | B1 | 4/2003 | Lorenz |
| 6,637,526 | B2 | 10/2003 | Juhasz et al. |
| 6,691,801 | B2 | 2/2004 | Juhasz et al. |
| 2002/0043403 | A1 | 4/2002 | Juhasz et al. |
| 2003/0167623 | A1 | 9/2003 | Lorenz |
| 2005/0000696 | A1 * | 1/2005 | McDaniel et al. ..... 166/379 |
| 2005/0051343 | A1 | 3/2005 | Pietras et al. |
| 2005/0077049 | A1 | 4/2005 | Moe et al. |
| 2005/0279507 | A1 | 12/2005 | Folk et al. |

FOREIGN PATENT DOCUMENTS

| | | |
|---|---|---|
| WO | WO 00/52297 | 9/2000 |
| WO | WO 03/025444 | 3/2003 |
| WO | WO 2004/090279 | 10/2004 |

OTHER PUBLICATIONS

EP Search Report, Application No. 07100289.3-2315, dated Aug. 24, 2007.

* cited by examiner

STAND COMPENSATOR

CROSS-REFERENCE TO RELATED APPLICATIONS

This application claims benefit of U.S. provisional patent application Ser. No. 60/758,486, filed Jan. 11, 2006, which is herein incorporated in its entirety by reference.

BACKGROUND OF THE INVENTION

1. Field of the Invention

The present invention relates to the connection of tubulars for use in a wellbore. More particularly the invention relates to an apparatus and method for supporting and compensating a tubular during connection.

2. Description of the Related Art

In the construction and completion of oil and gas wells, a drilling rig is used to facilitate the insertion and removal of tubular strings into a wellbore. The tubular strings are constructed by inserting a tubular into a wellbore until only the upper end of the tubular is out of the wellbore. A gripping member close to the surface of the wellbore then grips the tubular that is in the wellbore. The tubular string's upper end typically has a threaded box end for connecting to the next tubular. The next tubular to be connected to the tubular string is then lifted over the wellbore center. The next tubular has a lower end with a pin end for threadedly connecting to the box end of the tubular string. As the next tubular is connected to the tubular string it is critical to not damage the threaded connections between the tubular string and the tubular.

In order to facilitate tubular connection compensators have been used to prevent damage to the threads. During make up of the connections compensators support the weight of the tubular being lowered to minimize the axial load transferred from the pin to the box during makeup. Historically compensators have been used in conjunction with single joint elevators. The compensator is located between a traveling block and the single joint elevator. Another elevator is provided that is capable of supporting the entire tubular string. With the tubular being held by the single joint elevator the tubular is aligned with the box of the tubular string. An operator standing on the rig floor then aligns the pin and the box. A power tong, and/or pipe spinner is then used to connect the box and pin ends to form a tubular string while the axial travel of the thread make up is compensated for by the compensator. The tubular string is then engaged and supported by the second elevator that is capable of supporting the entire tubular string. The gripping apparatus near the wellbore surface or spider then releases the tubular string. The second elevator lowers the tubular string toward the wellbore surface.

The weight of the single joint elevator and the equipment to connect the elevator to the traveling block is much greater than the weight of the tubular to be compensated. The percentage of the weight of the tubular is small compared to the entire weight that is compensated. This causes the compensators to be ineffective when compensating.

As the top of the tubular string nears the surface of the wellbore the operator on the rig floor removes the single joint elevator from the tubular string. The operator then moves the single joint elevator toward the next tubular to be installed. The next tubular's box end is brought up to the rig floor so that the single joint elevator may grip it. Once the tubular string has gone as low as it will go with the elevator, the spider is activated to grip the string. The main elevator is then unlatched from the string. With the single joint elevator engaging the next tubular and the main elevator free the traveling block is lifted. The next tubular is lifted into a vertical position over the well center. The next tubular is located over the well center and the connection process will start again.

Efforts have been made to reduce the manpower on drilling rigs in order to prevent injury, and damage caused by human error. It is known to use automated pipe handling equipment. Such equipment helps reduce the number of people. The pipe handling equipment includes an arm or set of arms for grabbing a tubular to be installed from a rack and moves the tubular substantially over the well center for connection. The pipe handling equipment has very limited compensation capabilities. Thus, often times the insufficient compensation capabilities of the pipe handling equipment will damage the connections while handling the tubulars. This is especially true when using easily damaged tubulars such as chrome tubulars. The tubulars are then connected using power tong or pipe spinners in conjunction with the pipe handling system.

There is a need for enhanced compensation in combination with a traveling member. There is a further need to adapt the compensation for quick connection to a top drive or traveling block. There is yet a further need for a compensation system used in conjunction with a pipe handling system.

SUMMARY OF THE INVENTION

Embodiments described herein relate to methods and apparatus for connecting a tubular to a tubular string. In one embodiment, the method includes providing a compensator assembly having one or more compensator pistons and moving the compensator assembly to a position proximate the tubular by maneuvering a traveling member. The method may further include engaging the tubular with a plurality of engaging members operatively coupled to the compensator assembly and moving a lower end of the tubular into engagement with the tubular string which is supported by a gripping apparatus proximate a rig floor. In addition, the method may include rotating the tubular in order to facilitate connection of the tubular to the tubular string. Further still, the method may include compensating the engaging members during connection of the tubular to the tubular string by allowing the engaging members to axially translate with the tubular relative to the traveling member and disengaging the tubular from the engaging members.

In another embodiment, an apparatus for connecting a tubular to a tubular string includes a plurality of engaging members configured to grip and support the tubular; one or more compensator pistons operatively coupled to a traveling member, wherein the one or more compensator pistons are configured to support the weight of the engaging members and the tubular while allowing the engaging members to move axially relative to the traveling member during connection of the tubular to the tubular string; and a swivel configured to couple the engaging members to the compensator pistons thereby allowing the plurality of engaging members to rotate relative to the one or more compensator pistons.

In yet another embodiment, a method of protecting one or more compensation cylinders includes monitoring a pressure in one or more compensator cylinders during tubular handling operations; communicating the pressure to a controller; performing an action when the pressure reaches a predetermined value, wherein the action is initiated by the controller.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
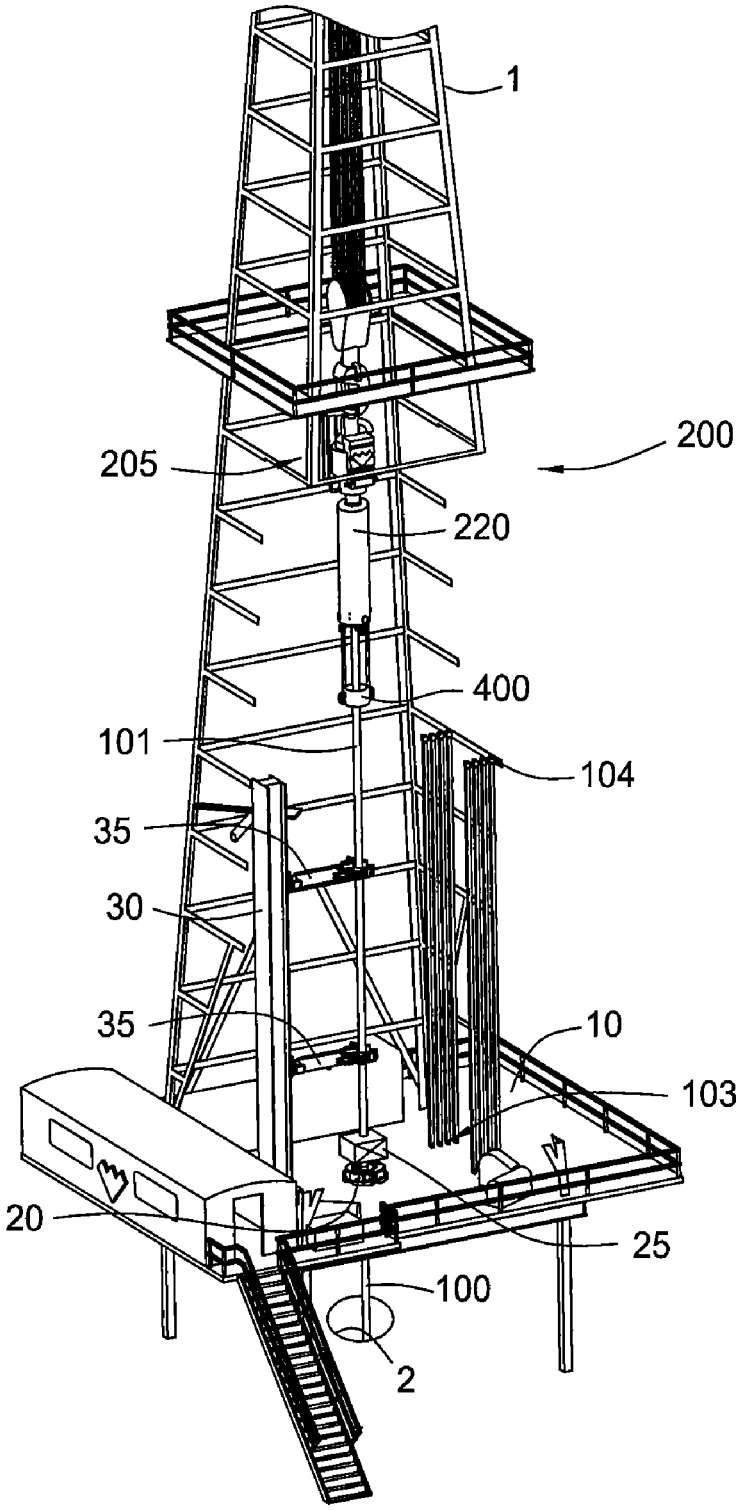
FIG. 1 is a schematic view of a drilling rig equipped having a compensator according to one embodiment described herein.

FIG. 1 is a perspective view of a drilling rig 1 depicting one embodiment described herein. The drilling rig 1 comprises a rig floor 10 with a gripping apparatus 20 located substantially in the center of the rig floor 10. The gripping apparatus 20 grips and supports the weight of a tubular string 100 including but not limited to slips. The gripping apparatus 20 is typically a spider, but can be anything adapted to support the weight of a tubular string 100. A tubular string 100 comprises one or more tubulars 101 that are coupled together on the rig 1 and run into a wellbore 2. As shown, the drilling rig 1 includes a tubular handling system 30. The handling system 30 retrieves the tubular 101 from a stack of tubulars on the drilling rig 1. The handling system 30 then centers the tubular 101 substantially over the tubular string 100 for connecting the tubular 101 to the tubular string 100. The rig 1 may optionally include a rotation mechanism 25, shown schematically, alternatively or in addition to the rotation of the tubular may be achieved using a top drive or a power swivel. The rotation mechanism 25 rotates the tubular 101 in order to facilitate connection to the tubular string 100. The rotation mechanism 25 may be any apparatus for rotating a tubular including but not limited to a pipe spinner, a power tong, a pipe wrench, or a rotary table. Further, the drilling rig 1 includes a traveling member 205 which connects to an assembly 200 for facilitating the tubular 101 travel and connection. The traveling member 205 may be any device capable of raising and lowering the assembly including, but not limited to, a traveling block, a top drive, and/or an elevator.

The assembly 200 may comprise the traveling member 205, a compensator assembly 220, and a main elevator 400. The assembly 200 facilitates connection of the tubular 101 to the tubular string 100. In operation, the handling system 30 grips the tubular 101 and locates it substantially over the well center, with a pin end 103 of the tubular 101 closest to a box end 104 of the tubular string 100. The traveling member 205 lowers the assembly 200 until the compensator assembly 220 engages the box end of the tubular 101. The compensator assembly 220 then supports the weight of the tubular(s) 101. The tubular 101 is then moved so that the pin end 103 engages the box 104 of the tubular string 100, for connection. The compensator assembly 220 then facilitates connection by compensating the weight of the tubular 101 during rotation.

In one embodiment, the rotation of the tubular 101 is performed by the rotation mechanism 25. The rotation mechanism 25 may be a power tong. With the tubular 101 rotating, and the compensator assembly 220 supporting and compensating the tubular 101 the pin 103 connects to the box 104. The main elevator 400 may then engage the tubular string 100, which includes connected tubular 101. The compensator assembly 220 disengages the tubular string 100, and the gripping apparatus 20 disengages the tubular string 100. The entire load of the tubular string 100 is now supported by the elevator 400. The traveling member 205 lowers the tubular string 100 so that the box end 104 is near the rig floor 10. The gripping apparatus 20 then engages the tubular string 100 and the main elevator 400 disengages the tubular string 100. The traveling member 205 lifts the assembly and the process is repeated until the tubular string 100 is the desired length.

In another embodiment, the traveling member 205 may be a top drive which rotates the tubular 101 during connection and the rotation mechanism 25 is not needed. Further, in another embodiment the handling system 30 is not used and the tubular is brought to the well center by the main elevator 400, manually or by an operator. It should be appreciated that the traveling member 205 is any apparatus for raising and lowering the tubulars, including but not limited to, a top drive, an elevator and/or a traveling block. Further, the traveling member 205 may include any combination of items known in the art.

Figure 2:
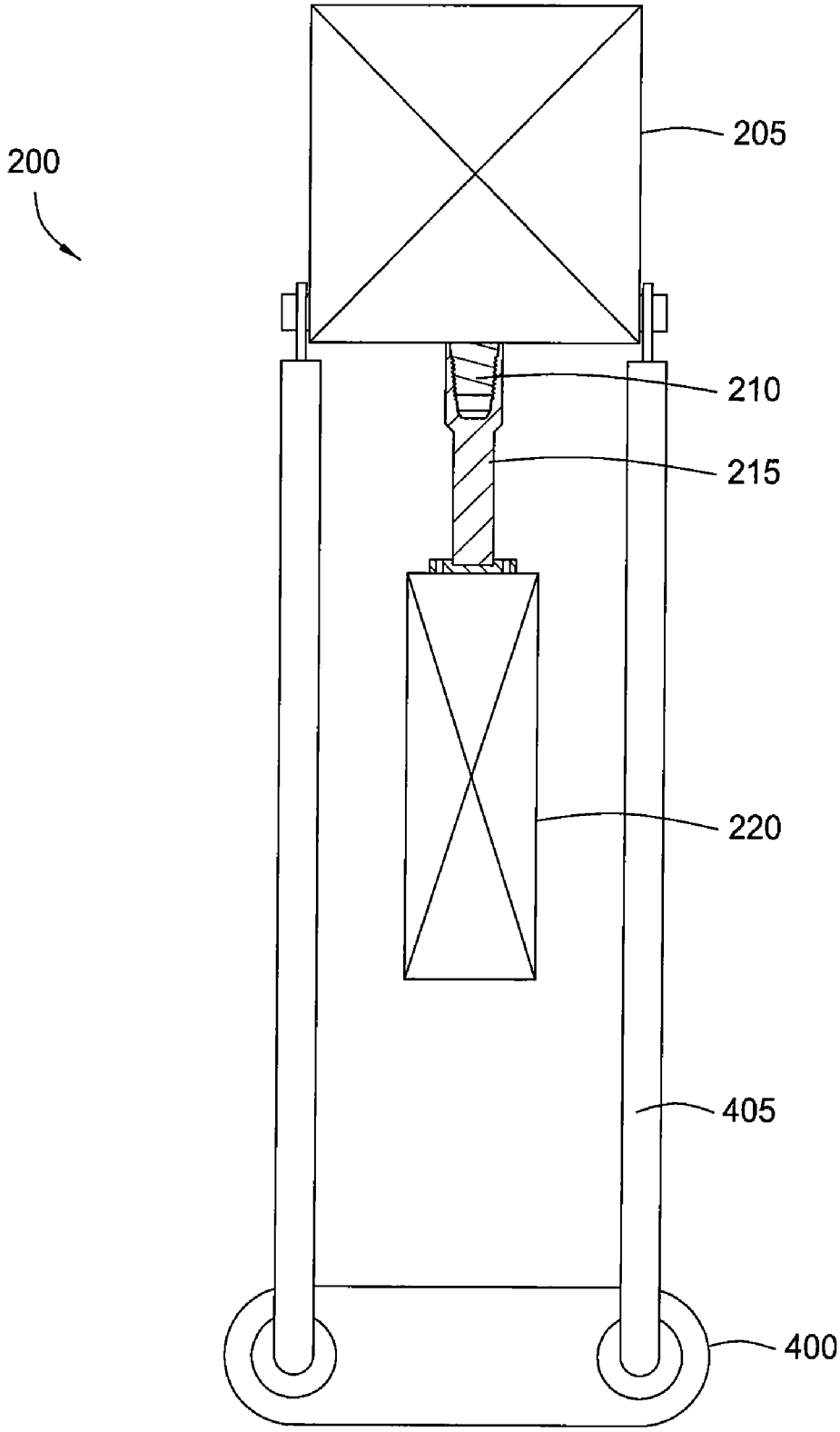
FIG. 2 is a schematic view of compensator according to one embodiment described herein.
Figure 3:
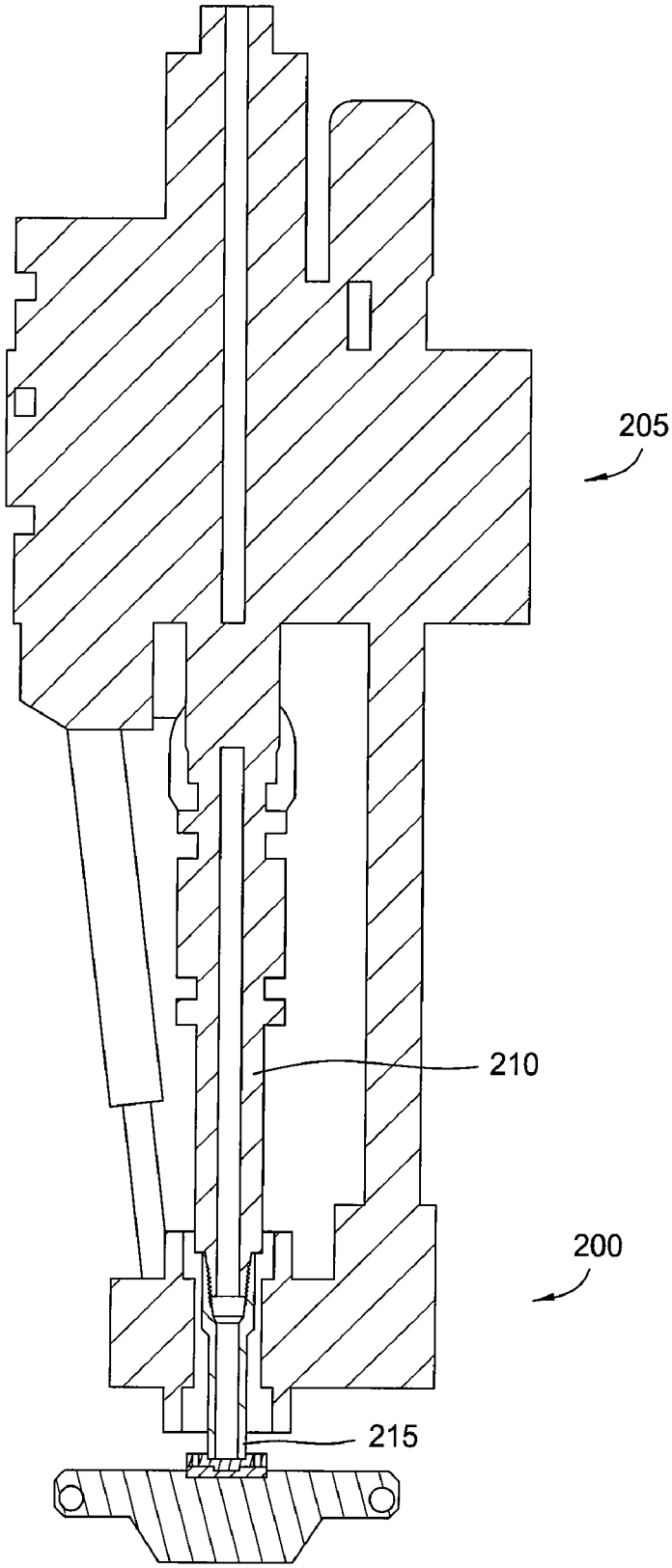
FIG. 3 is a cross-sectional view of an adapter sub for connecting a top drive to a compensator according to one embodiment described herein.

FIG. 2 depicts a schematic view of the assembly 200. The assembly 200 includes the traveling member 205 which connects to the compensator assembly 220 and the elevator 400. An adapter sub 215 connects the traveling member 205 to the compensator assembly 220. In one embodiment, the adapter sub 215 connects to a drive shaft 210 of a top drive, shown in FIG. 3. The adapter sub 215 may have threads which screw onto the end of the top drive shaft 210, although shown as a threaded connection it should be appreciated that the adapter sub 215 can connect to the shaft 210 in any manner known in the art, such as by welding, pin connectors, or clamps. The adapter sub 215 comes in any size desired to meet the requirements of the traveling member 205 and the drilling operation.

Further, the assembly 200 includes the main elevator 400, as shown in FIG. 2. The main elevator 400 connects to the traveling member 205 by bails 405. The main elevator 400 may be a tubular string elevator adapted to support the entire weight of the tubular string 100. It should be appreciated; however, that the main elevator 400 could be any elevator used in drilling operations, capable of supporting the weight of the tubular 101 or the entire tubular string 100. The elevator 400 may be automated for remote operation as discussed in more detail below.

Figure 4:
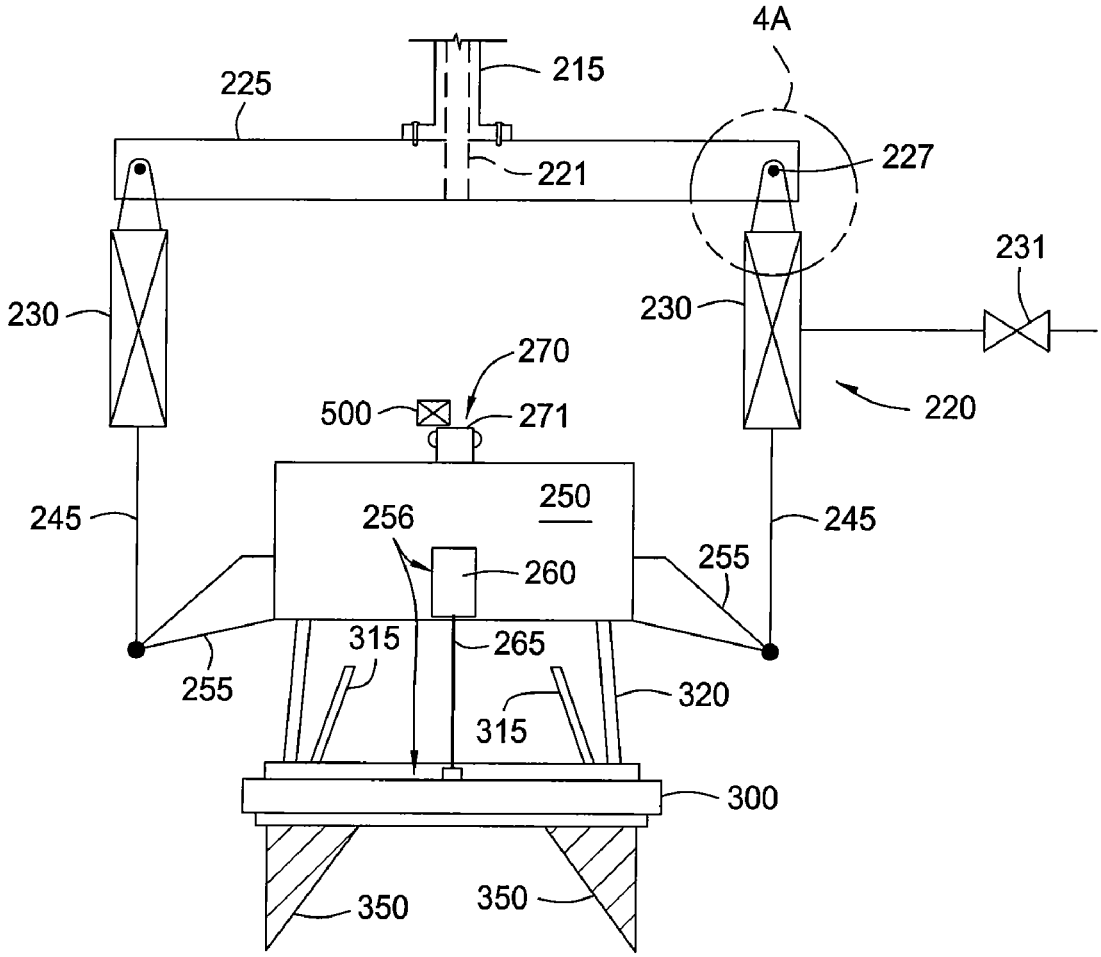
FIG. 4 is a front view of the compensator assembly according to one embodiment described herein.

FIG. 4 depicts a front view of the compensator assembly 220. In one embodiment, the compensator assembly 220 includes a yoke 225, one or more compensator cylinders 230, a housing 250, an engaging assembly 305 (shown in FIG. 5), a connector assembly 270, and an actuator 260. The yoke 225 connects to the adapter sub 215, as shown it is a bolted connection however any connection known in the art can be used. The yoke 225 optionally includes an aperture 221 through which a rotating member (not shown), would pass to transfer rotation from the top drive to the tubular 101. The yoke's 225 shape and structure are unimportant; so long as, the yoke 225 is strong enough carry the load created by tubular 101 and the rest of the compensator assembly 220.

Figure 4A:
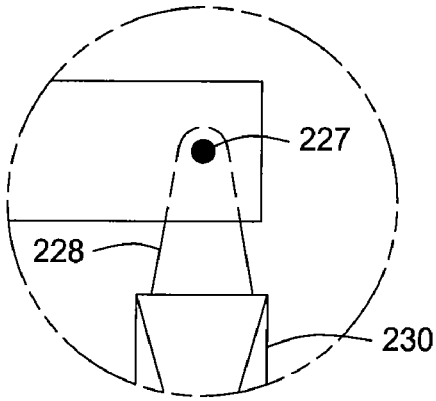
FIG. 4A is a front view of a connector according to one embodiment described herein.

In one embodiment, the yoke 225 connects to the one or more compensation cylinders 230 by a pin 227 connection. As shown in FIG. 4*a*, the connection is a simple pin 227 that hooks to a plate 228 connected to the compensator cylinder 230. However it is also contemplated to use spherical bearings (not shown). The spherical bearings allow the connection to have more freedom to sway as the tubular 101 is moved.

The one or more compensator cylinders 230 connect the yoke to the housing 255. The one or more compensator cylinders 230 are rated to support the load of a tubular 101. In another embodiment it is contemplated that the compensator cylinders 230 are rated to carry the load of any number of tubulars including the entire tubular string 100. The one or more compensator cylinders 230 include an optional relief valve 231. Should the compensation cylinders 230 become suddenly overloaded, due to accidental movement of the traveling block 40 or premature release of the gripping apparatus 20, the relief valve 231 would open to allow the one or more compensator cylinders 230 to relieve the sudden pressure change created by the load. In another embodiment the pressure in the compensator cylinders 230 may be monitored in order to prevent overloading of the cylinders as will be described in more detail below.

The one or more compensator cylinders 230 operate by supporting the load of the tubular 101 while allowing the housing 250 to move or float during connection of the tubulars. This prevents damage to threads, not shown, of the pin 103 and box 104 of the tubulars during compensator.

The one or more compensator cylinders 230 may include a piston rod 245 which connects to the housing 250 by a pin connection to a housing support 255, according to one embodiment. In an alternative embodiment the connection could be a spherical bearing as described above, or any other connection member. In one embodiment, there may be one housing support 255 for each compensation cylinder 230. The housing support 255 may be any shape so long as it operatively connects the one or more compensator cylinders 230 to the housing 250. Further, there could be any number of housing supports 255 including one, and any number of compensation cylinders 230 could attach to each housing support 250. The housing 250 as shown surrounds a portion of the connector assembly 270, however it should be appreciated that the housing could be any configuration. An actuator 256 may be operatively coupled to the housing 250. The actuator 256 includes one or more pistons 260 and a drive 300. The one or more pistons 260 may connect to the housing 250. A piston shaft 265 may connect to the drive 300 for operating the engaging assembly 305, described in more detail below.

Figure 5:
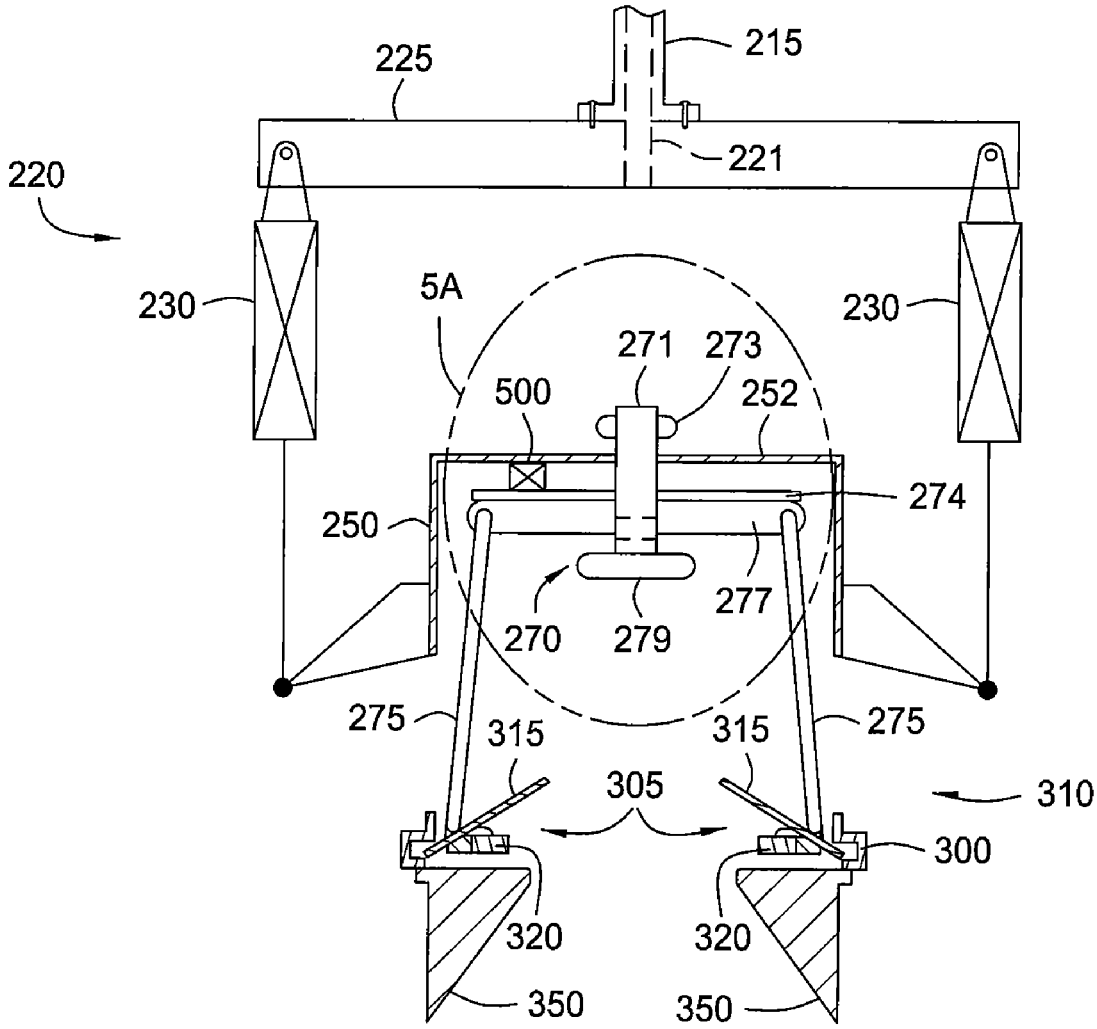
FIG. 5 is a cross-sectional view of the compensator assembly according to one embodiment described herein.
Figure 5A:
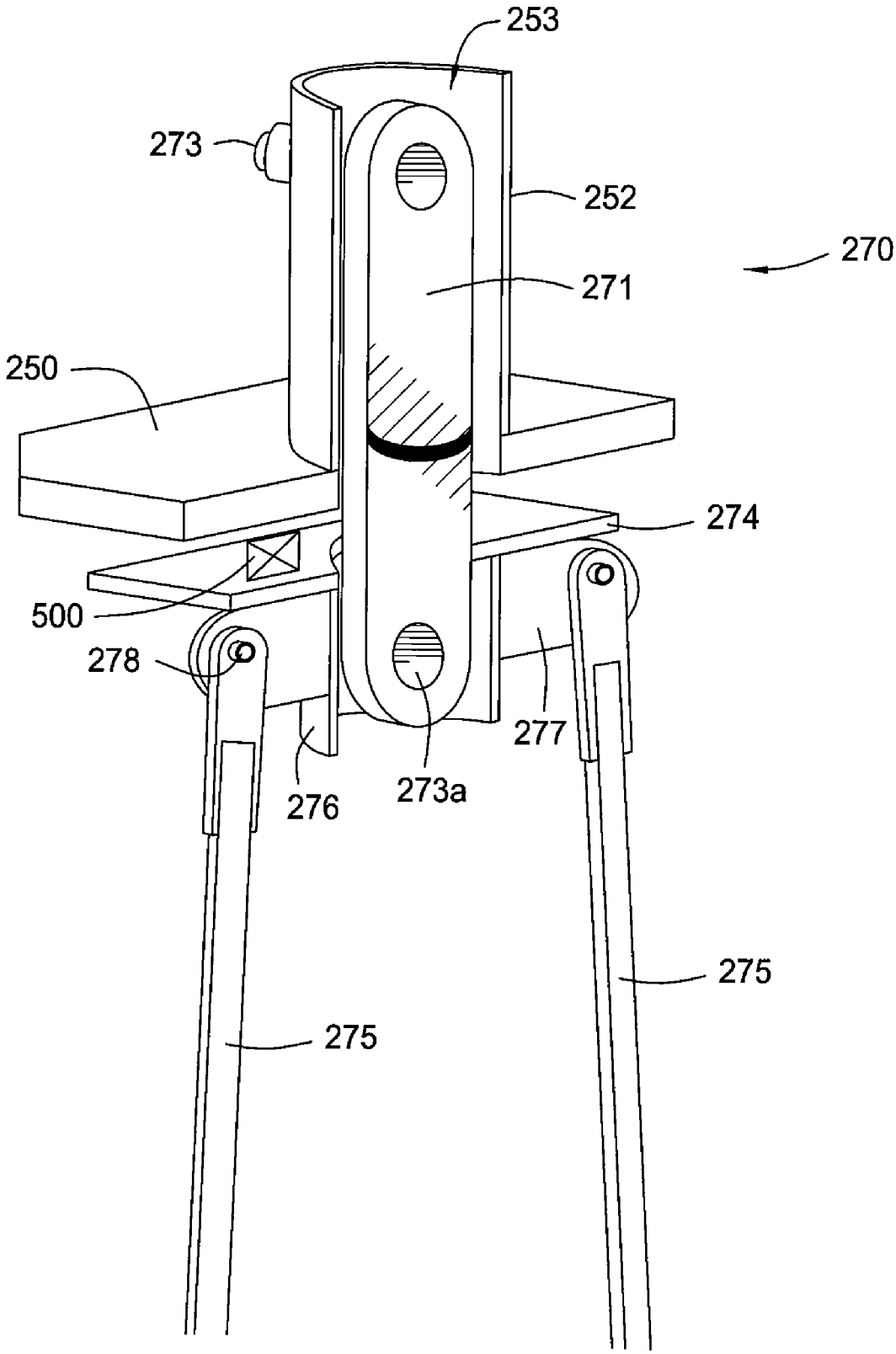
FIG. 5A is a cross-sectional perspective view of a connector assembly according to one embodiment described herein.

FIG. 5*a* shows the top end of the housing 250 having a first cylinder 252 with an aperture 253 through the cylinder 252 and the housing 250. The first cylinder 252 may be fixed to the housing 250. A swivel 271 may adapt to fit inside and protrude through the aperture 253. The swivel 271 may be a part of the connector assembly 270. The connector assembly 270 includes the swivel 271, an adapter 274 and one or more supports 275. The swivel 271 connects the housing 250 to the connector assembly 270. A pin 273 may connect the swivel 271 to the cylinder 252. The pin 273 is easily removable by an operator, to allow for removal of the connector assembly 270. The swivel 271 allows for rotation of the connector assembly 270 relative to the housing 250 while the housing supports the tubular 101.

In an alternative embodiment, the swivel 271 may be adapted to transfer rotation from a top drive to the tubular 101.

In one embodiment, the swivel 271 extends below the aperture 253 in the housing 250 for connection to the adapter 274. As shown, the adapter 274 includes a second cylinder 276 that connects to the swivel 271 with a pin 273*a*. The second cylinder 276 is operatively connected to the one or more supports 275 by a plate 277. Although shown as a cylinder and a plate for connection to the supports any configuration can be used. The plate 277 may have a pin or spherical bearing connection 278 for connection to the one or more supports 275. The bottom end of the second cylinder 276 is optionally equipped with a bumper 279, shown in FIG. 5. The bumper 279 is a rubber or elastomeric stopper that the tubular 101 will engage upon reaching the bumper 279. The bumper 279 dampens the impact of the tubular 101 and the connector assembly 270. The one or more supports 275 extend from the plate 277 to the engaging assembly 305, as shown in FIG. 5. As shown the one or more supports 275 are rods, however it should be appreciated that the supports 275 could be any device for supporting the engaging assembly 305.

Figure 6:
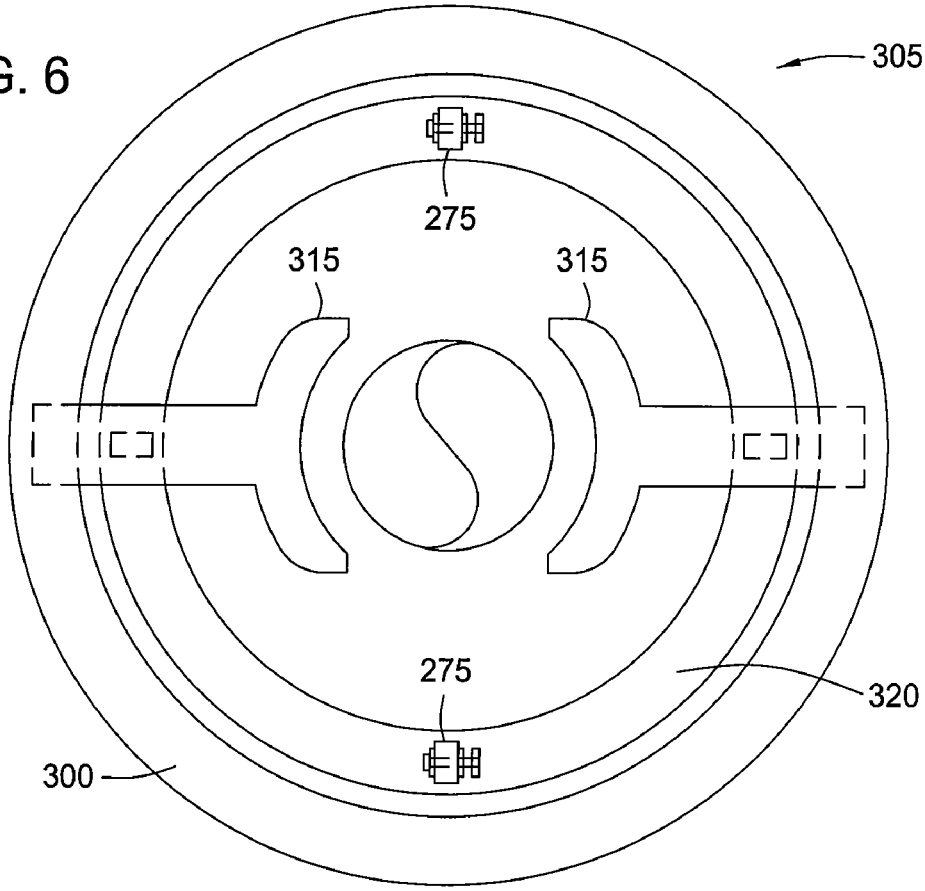
FIG. 6 is a top view of the engaging assembly according to one embodiment described herein.
Figure 7:
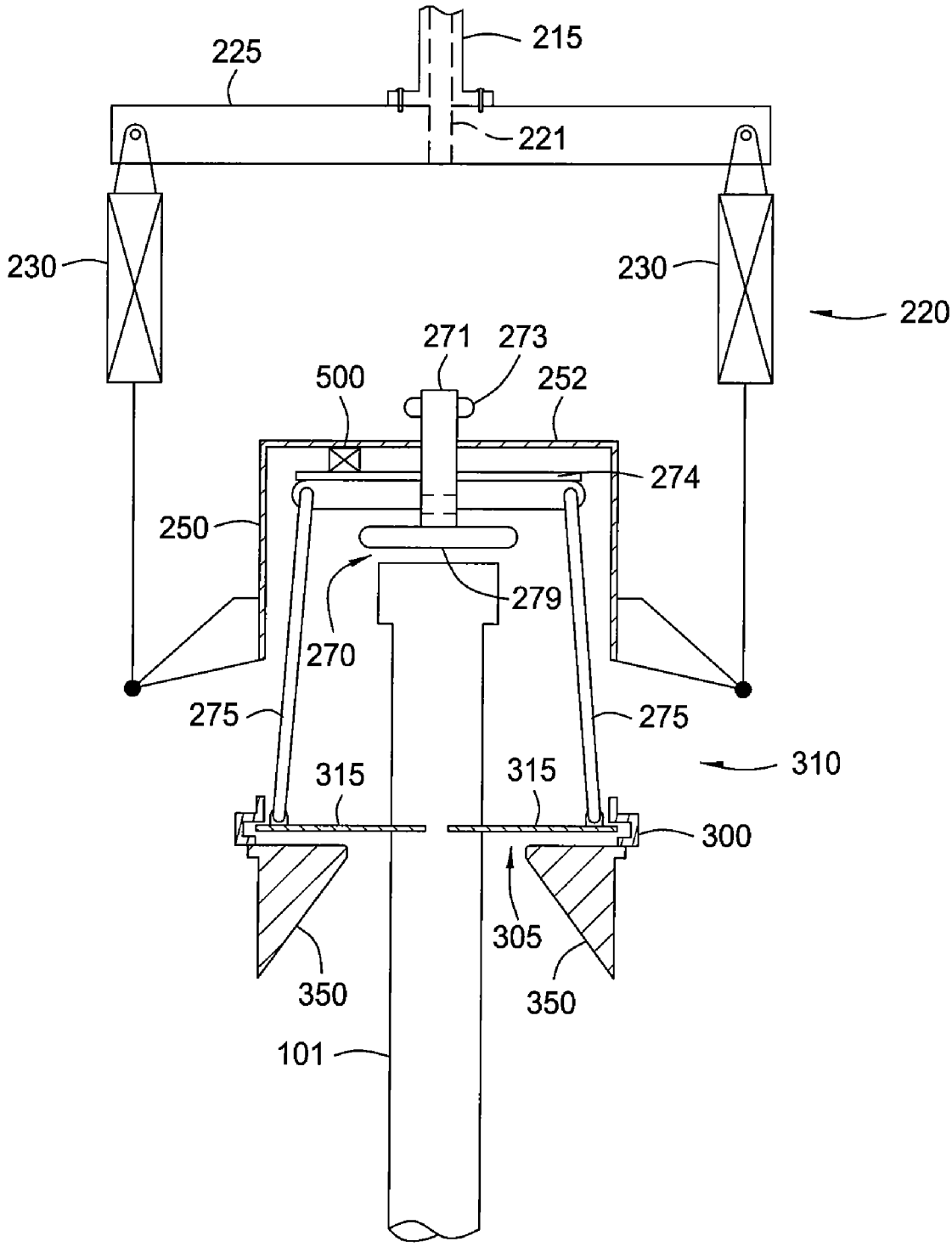
FIG. 7 a cross-sectional view of the compensator assembly according to one embodiment described herein.

The engaging assembly 305 may include a support ring 320 and one or more engaging members 315 in one embodiment. FIG. 6 shows a top view of the engaging assembly 305. As shown the support ring 320 connects to the one or more engaging members 315 to allow pivotable movement relative to the support ring 320. The support ring 320 connects to the supports 275. The one or more engaging members 315 may extend radially beyond the edge of the support ring 320 and into a recess in the drive 300. Thus, motion of the drive 300 will pivot the engaging members 315 from an open position as shown in FIGS. 4-6 to a closed position as shown in FIG. 7.

Figure 6A:
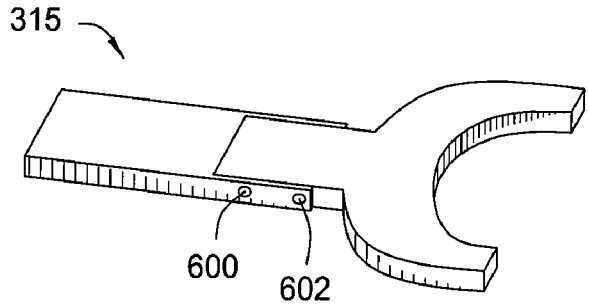
FIGS. 6A and 6B is a perspective view of engaging members according to one embodiment described herein.
Figure 6B:
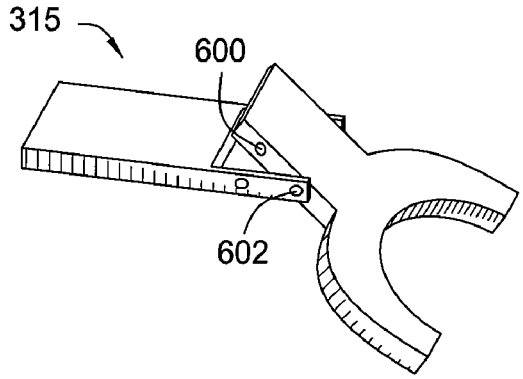

The one or more engaging members 315, although shown in FIGS. 6, 6*a* and 6*b* as arms, could be any known engaging member in the art, such as slips or a shoulder which a collar or upset of the tubular 101 rests on. Further, the engaging members 315 may be adapted to simply support the tubular 101 while allowing the tubular 101 to rotate or translate along the tubulars axis. In one embodiment, the one or more engaging members 315 are adapted to grip the tubular 101, thus limiting movement relative to the engaging members 315. In yet another embodiment, the engaging members 315 have teeth, wickers, fine grade particles or non marking grippers such as an elastomer (not shown) for providing better gripping of the tubular. In yet another embodiment, the engaging members 315 have a surface which grips the tubular 101, but will not mark or scratch the tubular.

The engaging members 315 may include a shear pin 600 and a pivot pin 602 in an alternative embodiment. The shear pin 600 is adapted to shear off at a desired load applied to the engaging members 315. Thus, if the traveling member 205 moves up before the engaging members 315 release the tubular 101 once the tubular 101 is coupled to the tubular string 100, the shear pins 600 will release the engaging members 315 from engagement with the tubular 101. Thus, the increased load will not be transferred to the compensator cylinders 230. Further, the load required to shear the shear pins 600 may be set to a load equal to or slightly less than the maximum load capacity of the compensator cylinders 600. It should be appreciated that although shown as shear pins any safety system for releasing the engaging members 315 from the tubular 101 could be used.

In one embodiment, the drive includes a guide 350, as shown in FIGS. 4, 5, 7 and 8. The guide 350 is below the drive 300 and the engaging assembly 305. The guide 350 has a larger opening at the bottom and is tapered so that the top has a smaller diameter than the inner diameter of the engaging assembly 305. Thus, as the compensator assembly 220 approaches the tubular 101 the guide will maneuver the compensator assembly 220 into the housing 250 without damaging the engaging assembly 305.

FIG. 7 shows the tubular 101 engaged in the compensator assembly 220. In one embodiment, as described above, traveling member 205 lowers the compensator assembly 220 to the top of the tubular 101 being held in the tubular handling system 30. The guide 350 engages the tubular 101 as the compensator assembly 220 travels down relative to the tubular 101. The guide 350 centers the compensator assembly 220 as the tubular 101 enters the housing 250. The compensator assembly 220 continues to lower, relative to the tubular 101, until the tubular 101 engages the bumper 279. The compensator assembly 220 then stops, either by an operator or automatically through use of a sensor 500. The one or more pistons 260 (shown in FIG. 4) then actuate the drive 300. The drive 300 moves the engaging members 315 into engagement with the tubular 101.

The tubular handling apparatus 35 now disengages the tubular 101 and the entire weight of the tubular 101 is supported by the compensator assembly 220. The tubular pin 103 inserts into the box 104 of the tubular string 100 and the rotation mechanism 25 activates to connect the tubulars. The engaging assembly 305 and connector assembly 270 are free to rotate relative to the housing 250 and the drive 300. The compensator cylinders 230 support and compensate the load of the tubular 101 during connection. With the tubular 101 connected to the tubular string 100 the elevator 400 engages the tubular string 100. The drive 300 disengages the engaging members 315 from the tubular. The gripping apparatus 20 on the rig floor 10 then disengages the tubular string 100. The entire weight of the tubular string 100 is now supported by the elevator 400. The traveling member 205 may then lower the tubular string 100 and the process is repeated as necessary.

Figure 8:
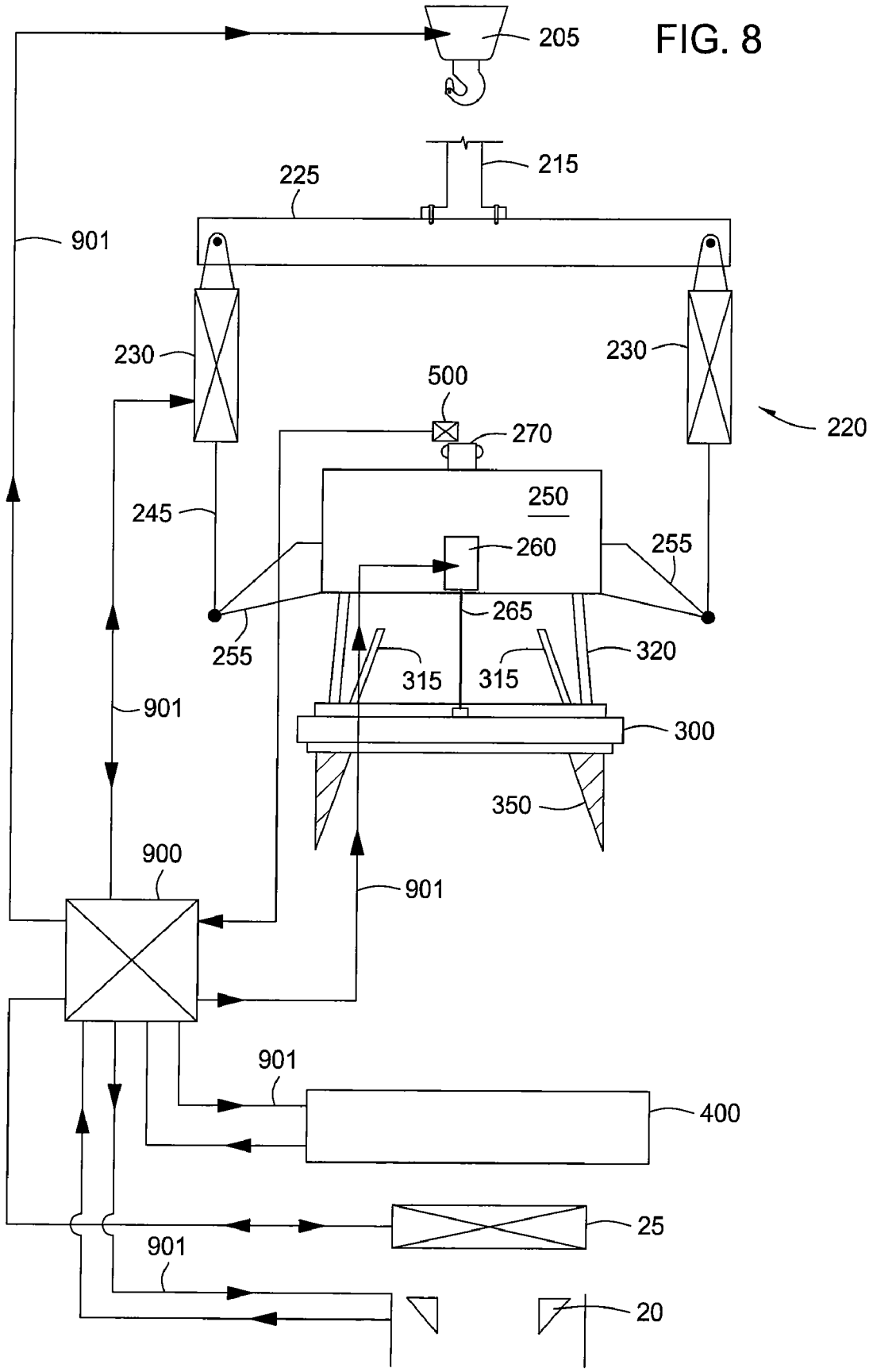
FIG. 8 is a schematic of an apparatus for handling wellbore tubulars according to one embodiment described herein.

FIG. 8 shows a schematic of a controller 900 for operation of a system for handling of wellbore tubulars according to one embodiment. The controller 900 may have control lines 901 running to the traveling member 205, the one or more pistons 260, the compensator cylinders 230, the elevator 400, the tubular handling system 30 (shown in FIG. 1), the rotating mechanism 25, and the gripping apparatus 20. The control lines 901 may be wires, hydraulic, pneumatic, or wireless communication lines, or any other control line, further the control lines may be any combination of communication/control lines. The controller 900 may send and/or receive data from the sensor 500, the elevator 400 and the gripping apparatus 20. The controller 900 can be in wireless (e.g., infrared, RF, Bluetooth, etc.) or in wired communication with any of the components of the described herein. Illustratively, the controller 900 is communicatively coupled to the traveling member 205, the piston 260, the compensator cylinders 230, the gripping apparatus 20, the tubular handling system 30, the rotation mechanism 25, the sensor 500 and the elevator 400. The controller 900 may generally be configured to operate each of the respective components in an automated fashion (e.g., according to a preprogrammed sequence stored in memory) or according to explicit user input.

Although not shown, the controller 900 may be equipped with a programmable central processing unit, a memory, a mass storage device, and well-known support circuits such as power supplies, clocks, cache, input/output circuits and the like. Once enabled, an operator may control the operation of the rig 1 by inputting commands into the controller 900. To this end, one embodiment of the controller 900 includes a control panel, not shown. The control panel may include a key pad, switches, knobs, a touch pad, display, etc.

If the compensator cylinders 230 becomes overloaded and fail, the replacement of the cylinders 230 or the cylinder seals would be time consuming and costly. Further, if the relief valve 231 or the shear pin 600 are set off or sheared, the compensator cylinders 230 would be saved from failure, but time would be lost in resetting the relief valve 231 or replacing the shear pins. Thus, the controller 900 may be adapted to monitor pressure in the compensation cylinders 230 in order to prevent failure of the cylinders. The controller 900 may be adapted to alert, through a visual signal, a display screen, an audio signal, or any other signal, an operator if the compensator cylinders 230 come close to the maximum load of the cylinder. Thus, the operator may then prevent the compensator cylinders 230 from failing, setting off the relief valve 231, or shearing the shear pin 600. In an embodiment, the controller 900 would alert the operator of high pressure in the compensator cylinders 230. The operator could then decide whether to stop the operation, or if necessary, let the operation continue which could then cause the relief valve 231 to be set off, the shear pin 600 to shear, or the compensator cylinders 230 to fail depending on the safety mechanisms in place. In an alternative embodiment, the controller 900 may be adapted to slow the travel of the traveling member 205 upon the compensator cylinders 230 approaching the overload pressure. This would afford the operator extra time to determine the best solution to the problem before failure. In yet another embodiment, the controller 900 may be completely automated and may stop the traveling member 205 before the compensator cylinders 230 failed. The controller 900 and/or operator may be located on the drilling rig or at a remote location.

In yet another embodiment, the controller 900 may be adapted to monitor the volume of fluid and/or volumetric changes in the fluid within each of the compensator cylinders 230. Further, the controller 900 may monitor the rate of change in fluid volume within the compensator cylinders 230. Further, the controller may monitor the volume and/or flow rate of the fluid supply/discharge to and/or from the compensator cylinders 230. Thus, the controller 900 is capable of monitoring any loss, increase or change in volume or flow rate of the hydraulic circuit operating the compensator cylinders 230. The controller 900 may monitor the system as a whole in order to determine if there are leaks or other problems. Further, the controller 900 may compare the volume and/or flow rate changes between each of the compensator cylinders 230 in order to determine if each compensator cylinder 230 is operating as expected. Thus, in the event one of the cylinders 230 has a leak the controller 900 may indicate which cylinder is leaking and/or overcome the deficiency by adjusting the supply and/or discharge from the cylinder 230, as appropriate. Thus, the controller 900 may maintain leaking the compensator cylinder 230 in a relatively balanced state in relation to the other compensator cylinders 230.

Further, an interlock system for preventing the controller 900 or an operator from inadvertently releasing the tubular 101 may be incorporated into the present system. The interlock may be adapted to prevent the inadvertent release of the tubular string from the gripping apparatus 20. The interlock may mechanically, fluidly or electronically prevent the gripping apparatus 20 from releasing the tubular 101 in the event that the compensator assembly 220 becomes overloaded. In one example the controller 900 monitors the pressure in the compensator cylinders 230. Upon reaching a threshold pressure the interlock will prevent the gripping apparatus 20 from releasing the tubular. In yet another example, the sensor (not shown) may be coupled to the arms 315. The sensor alert the controller 900 in the event that the arms 315 fail. The interlock would then prevent the gripping apparatus 20 from releasing the tubular. Examples of the interlock system are illustrated in U.S. Pat. No. 6,742,596. and U.S. Published Patent Application Nos. U.S. 2005/0096846, 2004/0173358 and 2004/0144547 which are herein incorporated by reference in their entireties.

In one embodiment the sensor 500 attaches to the connector assembly 270 and is activated upon the engagement of the tubular 101 and the bumper 279. The sensor 500 can be any type of sensor including but not limited to a strain gauge, a piston assembly, a switch, a valve. Upon activation of the sensor 500, the controller 900 may actuate stop the traveling member 205. The controller 900 may then activate the engaging members 315 in order to engage the tubular 101. The controller 900 may then release the tubular handling system 30 and activate the traveling member 205. The tubular 101 aligns with the tubular string 100 and the controller 900 may activate the rotation mechanism 25, or the top drive for connection. The controller may then stop the rotation mechanism 25, or the top drive and actuate the main elevator 400. The main elevator 400 engages the tubular string 100. The controller 900 may then actuate the piston 260 to release the engaging members 315. The controller 900 may then release the gripping apparatus 20. The controller 900 may then lower the traveling member 205. The controller 900 may then actuate the gripping apparatus 20 and releases the main elevator 400. The process is repeated until complete.

While the foregoing is directed to embodiments of the present invention, other and further embodiments of the invention may be devised without departing from the basic scope thereof, and the scope thereof is determined by the claims that follow.

The invention claimed is:

1. A method of connecting a tubular to a tubular string in a drilling rig, comprising:

providing a compensator assembly having one or more compensator pistons;

moving the compensator assembly to a position proximate the tubular by maneuvering a traveling block;

engaging the tubular with a plurality of engaging members operatively coupled to the compensator assembly;

moving a lower end of the tubular into engagement with the tubular string which is supported by a gripping apparatus proximate a rig floor;

rotating the tubular in order to facilitate connection of the tubular to the tubular string;

compensating the engaging members during connection of the tubular to the tubular string by allowing the engaging members to axially translate with the tubular relative to the traveling block;

disengaging the tubular from the engaging members;

supporting the tubular with a main elevator operatively coupled to the traveling block; and releasing the gripping apparatus.

2. The method of claim 1, wherein engaging the tubular with the plurality of engaging members prevents relative movement between the engaging members and the tubular thereby allowing the engaging members to rotate with the tubular and relative to the compensator assembly.

3. The method of claim 2, wherein the rotating of the tubular comprises actuating a rotation mechanism located proximate the rig floor.

4. The method of claim 3, further comprising gripping and moving the tubular with a tubular handling system coupled to the drilling rig to the center of the wellbore prior to moving the compensator assembly to a position proximate the tubular.

5. The method of claim 2, further comprising actuating the engaging members with one or more pistons operatively coupled to the compensator assembly in order to engage and disengage the tubular.

6. The method of claim 5, further comprising pivoting the engaging members about a substantially horizontal axis in order to engage and disengage the tubular.

7. The method of claim 1, further comprising monitoring a pressure in the one or more compensator pistons in order to prevent failure of the pistons.

8. The method of claim 7, further comprising preventing the gripping apparatus from releasing the tubular string when the pressure in the compensator pistons reaches a predetermined value.

9. An apparatus for connecting a tubular to a tubular string at a wellbore, comprising:

a plurality of engaging members configured to support the tubular; wherein at least one of the engaging members comprises an arm configured to pivot about a substantially horizontal axis from a first disengaged position to a second engaged position in which the engaging member is engaged with the tubular;

one or more compensator pistons operatively coupled to a traveling member, wherein the one or more compensator pistons are configured to support the weight of the engaging members and the tubular while allowing the engaging members to move axially relative to the traveling member during connection of the tubular to the tubular string; and a swivel configured to couple the engaging members to the compensator pistons thereby allowing the plurality of engaging members to rotate relative to the one or more compensator pistons.

10. The apparatus of claim 9, further comprising a shear member configured to disengage the arm from the tubular in the event a predetermined load is applied to the tubular when the arm is in the engaged position.

11. The apparatus of claim 9, further comprising an interlock configured to prevent a gripping apparatus from releasing the tubular string in the event that the one or more compensator pistons become overloaded.

12. The apparatus of claim 11, further comprising a controller for monitoring the pressure in the one or more compensator pistons.

13. The apparatus of claim 9, further comprising a main elevator coupled to the traveling member adapted to support the weight of the tubular string.

14. The apparatus of claim 9, further comprising a controller configured to activate and deactivate the plurality of engaging members.

15. The apparatus of claim 14, further comprising a sensor member configured to send data to the controller relating to the position of the tubular in the apparatus.

16. The apparatus of claim 9, further comprising a connector assembly with a bumper member configured to dampen the impact between the connector assembly and the tubular.

17. The apparatus of claim 16, further comprising a housing connected to the one or more compensator pistons.

18. The apparatus of claim 17, wherein the swivel is configured to connect the connector assembly to the housing.

19. The apparatus of claim 9, wherein the swivel is adapted to transfer rotation from a top drive to the tubular.

* * * * *